US011287161B2

(12) United States Patent
Höfer et al.

(10) Patent No.: US 11,287,161 B2
(45) Date of Patent: Mar. 29, 2022

(54) HEATING SYSTEM COMPONENT PROVIDING A COMPACT TEMPERATURE SENSOR DESIGN

(71) Applicant: Bleckmann GmbH & Co. KG, Lamprechtshausen (AT)

(72) Inventors: Johann Höfer, St. Georgen (AT); Andreas Pleschinger, Schleedorf (AT); Hubert Unterberger, Bürmoos (AT)

(73) Assignee: Bleckmann GmbH & Co. KG, Lamprechtshausen (AT)

( * ) Notice: Subject to any disclaimer, the term of this patent is extended or adjusted under 35 U.S.C. 154(b) by 631 days.

(21) Appl. No.: 16/311,036

(22) PCT Filed: Jun. 20, 2017

(86) PCT No.: PCT/EP2017/065051
§ 371 (c)(1),
(2) Date: Dec. 18, 2018

(87) PCT Pub. No.: WO2017/220554
PCT Pub. Date: Dec. 28, 2017

(65) Prior Publication Data

US 2019/0346175 A1 Nov. 14, 2019

(30) Foreign Application Priority Data

Jun. 20, 2016 (EP) ..... 16175278

(51) Int. Cl.
*F24H 9/20* (2006.01)
*F24H 1/16* (2006.01)
*H05B 1/02* (2006.01)

(52) U.S. Cl.
CPC ..... *F24H 9/2028* (2013.01); *F24H 1/162* (2013.01); *H05B 1/0283* (2013.01); *F24H 2250/04* (2013.01)

(58) Field of Classification Search
None
See application file for complete search history.

(56) References Cited

U.S. PATENT DOCUMENTS 1,418,011 A * 5/1922 Mehn ..... F24H 1/162 392/479
1,838,680 A * 12/1931 Hudson ..... H05B 3/28 392/481

(Continued)

FOREIGN PATENT DOCUMENTS

CN 102297506 A 12/2011
CN 102297506 B 4/2013

(Continued)

OTHER PUBLICATIONS

EPO; Application No. PCT/EP2017/065051; International Search Report dated Sep. 4, 2017.

(Continued)

*Primary Examiner* — Thor S Campbell
(74) *Attorney, Agent, or Firm* — Fitch, Even, Tabin & Flannery LLP

(57) ABSTRACT

The invention relates to a heating system component for a heating system for heating a fluid medium, with a carrier unit, and a heating unit coupled to said carrier unit, wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit. A temperature sensor, in particular an NTC thermistor, positioned to measure a temperature of a fluid medium at the wet side of the carrier unit, wherein the temperature sensor is effectively thermally insulated from the heating unit.

9 Claims, 8 Drawing Sheets

(56) References Cited

U.S. PATENT DOCUMENTS 2,420,175 A * 5/1947 Johnstone ..... F24H 1/162 392/481
3,782,456 A * 1/1974 Gusmer ..... F28D 7/0041 165/164
4,255,646 A * 3/1981 Dragoy ..... F17C 7/04 137/341
4,356,381 A * 10/1982 Flaherty, Jr. ..... A47J 31/545 219/526
4,460,819 A * 7/1984 Eugster ..... F24H 1/142 392/467
4,558,205 A * 12/1985 Bleckmann ..... H05B 1/0269 392/467
4,778,977 A * 10/1988 Bleckman ..... A47J 31/542 138/115
4,825,042 A * 4/1989 Hauslein ..... A47J 31/545 392/467
4,992,690 A * 2/1991 Baker ..... F04D 13/06 310/89
6,442,341 B1 * 8/2002 Wu ..... A47J 31/542 392/479
7,293,958 B2 * 11/2007 Kraffzik ..... F04D 29/588 415/206
7,455,065 B2 * 11/2008 Schrott ..... F04D 29/426 134/56 D
7,538,301 B2 * 5/2009 Teufl ..... H05B 3/44 219/523
7,560,672 B2 * 7/2009 Pleschinger ..... F24H 9/2028 219/545
9,371,841 B2 * 6/2016 Verma ..... F04D 29/406
9,631,835 B2 * 4/2017 De Mango ..... A47J 31/542
10,641,521 B2 * 5/2020 Wedam ..... B22D 17/24
10,724,547 B2 * 7/2020 Zoppas ..... A47L 15/4285
2004/0026411 A1 * 2/2004 Mucke ..... H05B 3/26 219/543
2007/0012685 A1 * 1/2007 Gourand ..... H05B 3/22 219/628
2007/0228032 A1 * 10/2007 Reiter ..... F24H 9/20 219/543
2008/0283094 A1 * 11/2008 Nagel ..... A47L 15/4285 134/10
2009/0135882 A1 5/2009 Kloíber et al.
2010/0119360 A1 * 5/2010 Bredl ..... F04D 29/588 415/178
2010/0126534 A1 * 5/2010 Busing ..... F04D 29/4293 134/105
2013/0055902 A1 * 3/2013 Berto ..... A47J 31/542 99/281
2013/0202279 A1 * 8/2013 Reichl ..... F24H 1/142 392/480
2015/0233573 A1 8/2015 Ke
2016/0109152 A1 * 4/2016 Teufl ..... A47J 27/21083 392/318
2019/0335540 A1 * 10/2019 Hofer ..... F22B 35/18
2021/0145208 A1 * 5/2021 Zhang ..... F24H 9/0015

FOREIGN PATENT DOCUMENTS

CN 203478587 U 3/2014
DE 102012013347 A1 1/2014
EP 1152639 A2 11/2001
EP 2905534 A1 12/2015

OTHER PUBLICATIONS

EPO; Application No. 19165000.1; Extended European Search Report dated Jun. 27, 2019.
KIPO; Application No. 10-2019-7000347; Office Action dated Jul. 19, 2021.

* cited by examiner

HEATING SYSTEM COMPONENT PROVIDING A COMPACT TEMPERATURE SENSOR DESIGN

CROSS-REFERENCE TO RELATED APPLICATIONS

This application is a U.S. national phase application filed under 35 U.S.C. § 371 of International Application PCT/EP2017/065051, filed Jun. 20, 2017, designating the United States, which claims priority from European Application Number 16175278.7, filed Jun. 20, 2016.

FIELD OF THE INVENTION

The invention relates to a heating system component for heating fluid media in a heating system of a household appliance, in particular, to heating system component comprising at least one temperature sensor.

BACKGROUND OF THE INVENTION

For many types of domestic appliances or domestic machines, it is necessary to heat up a fluid medium, such as for example water. Heating up can be caused by means of one or more heating systems. To that extent, a medium circuit can be provided, a pump arranged in the circuit causing circulation of the medium in the circuit.

Basic aspects of such heating systems are that, like all other components of the medium circuit, the system is to take up only a small amount of space and is to be inexpensive to produce. Furthermore, the heating system shall be simple to assemble. Reliable safeguarding of the heating system must be guaranteed upon the occurrence of a critical operating condition which can result in plastic components within the domestic appliance melting or catching fire. In case of some domestic appliances, it may further be necessary to prevent the medium to be heated from exceeding a predetermined temperature. For example, in the case of a dishwashing machine, it may be necessary to prevent the washing water from exceeding its boiling temperature.

US patent application 2006/0236999 A1 discloses a heating system for heating fluid media, in particular for domestic appliances, including a carrier unit, a heating unit arranged on the carrier unit and a heat transfer element which is arranged on the carrier unit and comprising a material which is a good conductor of heat. On the heat transfer element, temperature safety devices are mounted by fixing elements via corresponding through apertures.

It is a general object of the manufacture of heating systems and heating system components to provide ever smaller and more compact construction parts, which provide a sufficient heating power (if not the same heating power as before). It is a further object to reduce manufacturing costs.

In addition, when using conventional temperature monitoring and/or control elements (such as, e.g., thermal fuses) with continuous-flow water heaters, there is a problem when the temperature monitoring and/or control elements are fixed with, e.g., one or more screws, to a mounting plate. That is, when the mounting plate is soldered to the heating unit, it may curve. Further, when fastening respective fixing screws on a temperature monitoring and/or control element, the temperature monitoring and/or control element may be lifted from the fixing plate and remain in the air above the hot location. As a consequence, the largest amount of heat in the center of the heating unit cannot be released directly to the temperature monitoring and/or control element, but has to be released via, e.g., the mounting plate, screws, and/or the base plate flange. These effects result in an unacceptable (i.e., too slow) response time of the temperature monitoring and/or control element. Accordingly, it would be advantageous to directly mount a temperature sensor at the position where a certain temperature should be monitored. NTC thermistors are temperature sensors well known in the art. However, the rather inexpensive NTC thermistors may not continuously be exposed to temperatures exceeding 100° C. Since a heating unit of a heating system component usually reaches temperatures above 100° C., inexpensive NTC thermistors are usually not suitable for being directly mounted to or near the heating unit within the heating system component, thus preventing more compact design.

An object of the present invention is therefore to provide a heating system component which avoids the shortcomings of prior-art heating systems.

SUMMARY OF THE INVENTION

According to a first aspect of the present invention, there is provided a heating system component for a heating system for heating a fluid medium, said heating system component comprising a carrier unit and a heating unit coupled to said carrier unit. The carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit. The heating system component further comprises at least one temperature sensor, in particular an NTC thermistor, wherein said temperature sensor is effectively in thermal contact with at least a part of an upper surface of said dry side of the carrier unit wherein the part of the upper side of the carrier unit is in contact with said fluid medium at the wet side and wherein the part of the upper side of the carrier unit is effectively thermally insulated from the heating unit.

Being effectively in thermal contact with at least a part of an upper surface of said dry side of the carrier unit does require a direct contact of the temperature sensor with the upper surface of the dry side of the carrier unit. However, the effective thermal contact shall be understood as providing a thermal contact which allows a measurement of the fluid medium circulating at the wet side of the carrier unit. Thus, the thermal contact should ensure a major impact on the measured temperature coming from the fluid medium on the wet side of the carrier unit. The temperature sensor may also measure a mix temperature of the fluid and the heating unit. By providing the temperature sensor, in particular an NTC thermistor, effectively in thermal contact with at least a part of an upper surface of said dry side of the carrier unit, wherein said at least part of the upper side of the carrier unit is effectively thermally insulated from the heating unit, it can be ensured that the temperature sensor is not exposed to temperatures exceeding the maximal temperature of the fluid circulated on the wet side of the carrier unit, which in most common household appliances is 100° C. Within this temperature regime, it is possible to use common cost-effective NTC thermistors which further allow a compact design of the heating system component with reduced material budget.

In an embodiment, said heating system further comprises a heat conducting plate covering at least a part of the groove, wherein the heat conducting plate comprises a detached portion at a circumferential part detached from the heating unit recessed in the groove, the detached portion has a projecting part extending beyond the groove of the carrier unit, the projecting part is in direct contact with the dry side of the carrier unit; and the temperature sensor is mounted at the projecting part, and wherein the detached portion of the heat conducting plate preferably comprises trenches in radial direction of respective peripheral edges of the projecting part. Preferably, the heating system component may further comprise a second temperature sensor, in particular an NTC thermistor, wherein said second temperature sensor is in thermal contact with an upper surface of the heat conducting plate covering the heating unit inside the groove.

In a further embodiment, said heating system component the temperature sensor is provided inside the groove of the carrier unit shielded from the heating unit by a shielding unit. Preferably, the shielding unit is made of stainless steel or aluminum oxide. In a further preferable implementation, a second temperature sensor is provided inside the groove shielded from the heating unit by a shielding unit, wherein the resulting temperature is derived from an average temperature measured by the first and second temperature sensors. In a yet further preferable implementation the first and second temperature sensors are NTC thermistor pills cast in epoxy resin between the dry side of the carrier unit and the shielding unit. The compact, yet cost-efficient design provided by this embodiment allows a reliably measurement of the fluid temperature on the wet side of the carrier unit while providing an easy assemble of the heating system component within a respective household appliance. Since the temperature measurement components are provided inside the groove, the risk of damages during assembly is significantly reduced.

In an embodiment, the heating system component further comprises a heat conducting plate covering at least a part of the groove, wherein the heat conducting plate comprises a projecting part extending beyond the groove of the carrier unit, the projecting part being in direct contact with the dry side of the carrier unit; and wherein the temperature sensor is provided at a ceramic pad fixed at a projection part of the carrier unit. Preferably, a second temperature sensor is positioned on a second ceramic pad, wherein the second ceramic pad is fixed at a position of the heat conduction plate covering the groove. In a further preferable implementation one or more conductor paths are provided along the heat conduction plate to connect the one or more temperature sensors, wherein the conductor paths are insulated from the heat conduction plate by an insulating layer, preferable comprising a polyimide, such as—but not limited to—Kapton, a polyamide or a polyester.

In a further embodiment, the heating system component further comprises a heat conducting plate covering at least a part of the groove, wherein the heat conducting plate comprises a projecting part extending beyond the groove of the carrier unit, the projecting part being in direct contact with the dry side of the carrier unit; wherein at least a part of the heat conducting plate is covered with an insulating layer on top of which the temperature sensor and conductor paths connected to the temperature sensor are formed. Preferably, the heating system component comprises a plug with pins to be connected to the conductor paths wherein the plug also provides electric connections for the heating unit. Preferably, the temperature sensor, the conductor paths and the insulating layer are formed at the heat conducting plate by printing or thermal spraying. Alternatively, the insulating layer may also be attached directly to a portion of the dry side of the carrier unit. Preferably, the temperature sensor and the conductor paths are formed at the insulating layer before being attached to the carrier unit. The insulating layer may be connected to a respective plug and afterwards being glued to the carrier unit, wherein the plug may be welded to the heating unit connection pins and or the carrier unit.

In a further embodiment, the carrier unit comprises an undercut portion which is covered with a thermoplastic layer doped with a metal-plastic additive directly sprayed at the undercut portion and subsequently metalized at respective portions of an upper surface of the thermoplastic layer; wherein the temperature sensor and conductor paths connected to the temperature sensor are formed at the metalized thermoplastic layer by laser cutting. Preferably, the heating system component comprises a transparent plug comprising the electrical contacts to be connected with the conductor paths leading to the temperature sensor wherein the transparent plug is coupled with the thermoplastic layer via laser welding.

In an embodiment, the heating system component further comprises a heat conducting plate covering at least a part of the groove, wherein the heat conducting plate comprises a projecting part extending beyond the groove of the carrier unit, the projecting part being in direct contact with the dry side of the carrier unit; wherein at least a part of the heat conducting plate is covered with a thermoplastic layer doped with a metal-plastic additive directly sprayed at least at a part of the projecting part and subsequently metalized at respective portions of an upper surface of the thermoplastic layer; wherein the temperature sensor and conductor paths connected to the temperature sensor are formed at the metalized thermoplastic layer by laser cutting. Preferably, the heating system component comprises a transparent plug comprising the electrical contacts to be connected with the conductor paths leading to the temperature sensor wherein the transparent plug is coupled with the thermoplastic layer via laser welding.

It shall be understood that a preferred embodiment of the invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
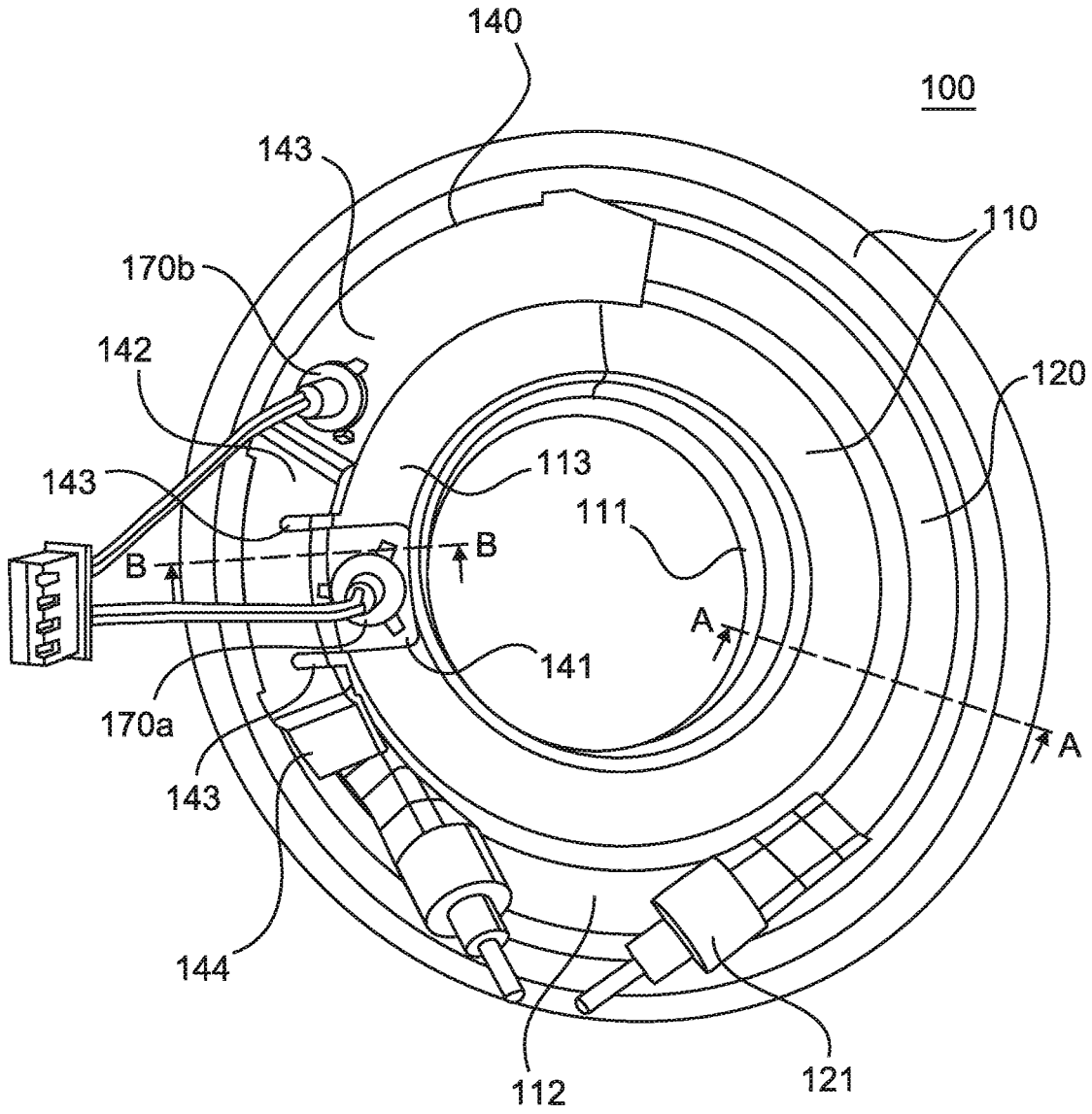
FIG. 1 shows schematically and exemplarily an embodiment of a heating system component.

FIG. 1 shows schematically and exemplarily an embodiment of a heating system component 100. Heating system component 100 comprises a carrier unit 110 and a heating unit 120.

Heating system component 100 may be connected to, e.g., a conveyor pump of a domestic appliance such as—but not limited to—a dishwashing machine. Heating system component 100 can be attached to the conveyor pump or to a conveyor pump housing during assembly of the domestic appliance. In another example, heating system component 100 can form a pre-assembled structural unit together with the conveyor pump.

As can be seen from FIG. 1, carrier unit 110 is a circular disc. In concentric relationship with its central axis (not shown), carrier unit 110 has a circular hole 111, through which a suction pipe of the conveyor pump is passed in sealing integrity in relation to the medium. At its outer peripheral edge, carrier unit 110 may engage over the edge of the conveyor pump's housing in sealing integrity in relation to the medium. That backside of carrier unit 110 as shown in FIG. 1, is in direct contact with the medium to be heated in the installed condition of the pump and can therefore be referred to as the wet side 101 whereas the side of carrier unit 110 shown in FIG. 1, does not come into contact with the medium and can thus be referred to as the dry side 102.

Figure 2A:
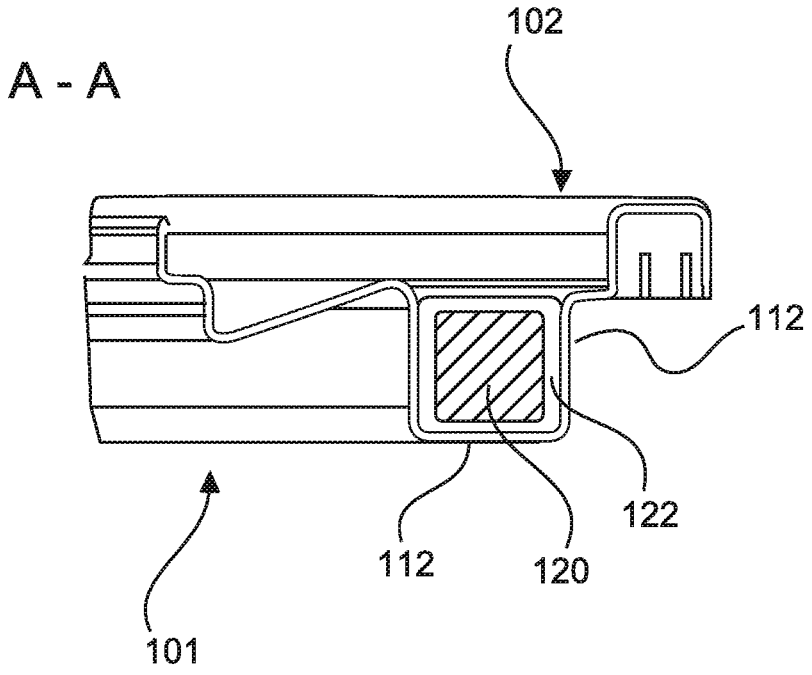
FIGS. 2*a* and 2*b* show schematically and exemplarily a cross-section view of the heating system component according to FIG. 1.

Heating unit 120 is arranged on the dry side 102 of carrier unit 110 as shown in FIG. 2*a* illustrating the cross sectional view along line A-A in FIG. 1. Heating unit 120 is coupled to carrier unit 110 by means of a coupling step. The coupling step may comprise any one of a soldering step, a laser welding step, a gluing step, an ultrasonic welding step, and/or a friction welding step.

Carrier unit 110 may comprise a composite material. The composite material comprises at least an aluminum layer and a stainless steel layer. The stainless steel layer is arranged on the wet side 101 of carrier unit 110. The aluminum layer is arranged on the dry side 102 of carrier unit 110. In an example, the composite material may be produced by means of a cold roll bonding process.

In the embodiment illustrated in FIG. 1, carrier unit 110 further comprises groove 112. Groove 112 is configured to receive heating unit 120. Heating unit 120 comprises a first cross section which is perpendicular to an axial direction of heating unit 120. The first cross section may have a rectangular shape, a hat-like trapezoid with rounded edges, a bell-like trapezoid with rounded edges.

In the embodiment illustrated in FIG. 1, a cross section of groove 112 corresponds to said first cross section of heating unit 120. In particular, heating unit 120 is arranged in groove 112 as shown in FIG. 2*a*. The cross section of groove 112 and the cross section of heating unit 120 are chosen such that at least a part of a surface of heating unit 120 and a part of said dry side 102 form a flat face. In FIG. 2*a* all three sides of heating unit 120 are welded to the surfaces of the groove 112 of the carrier unit 110. The necessary close contact between the surfaces of heating unit 120 and carrier unit 110 may be achieved by applying a press preload to heating unit 120 during the coupling step. Optionally, a thermally conducting paste 122 may be applied to one or both of the surfaces of carrier unit 110 and heating unit 120. By employing a thermally conducting paste, problems associated with an occurrence of voids between carrier unit 110 and heating unit 120 may be avoided.

Another possibility for addressing problems associated with an occurrence of voids between carrier unit 110 and heating unit 120 is to arrange a phase change compound between carrier unit 110 and heating unit 120. Such a compound changes its phase state above its phase change temperature and is thereby able to fill cracks, voids, slits, etc. In an embodiment, the phase change compound is applied to the surfaces of carrier unit 110 and/or heating unit 120 by means of a dispensing step. Dispensing typically implies that the phase change compound dries within a short period of time.

Figure 2B:
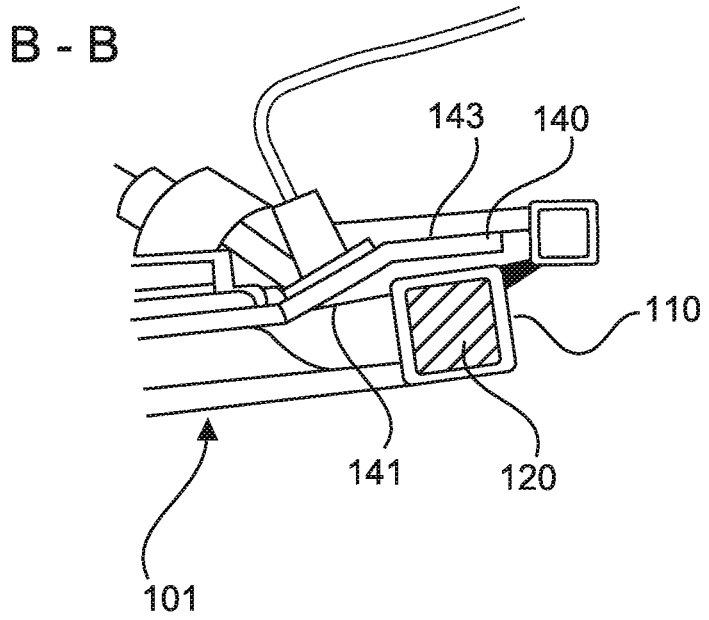

In the embodiment illustrated in FIG. 1, heating system component 100 further comprises a temperature sensor 170*a*, preferably an NTC (Negative Temperature Coefficient) thermistor, connectable to a processing unit of the domestic appliance in order to measure the temperature of the fluid circulating on the wet side of the heating system component 100. NTC thermistors provide a cost effective way of determining the temperature. However, such common inexpensive NTC thermistors only sustain continuous operation in a temperature regime of up to 100° C. Since heating unit 120 usually reaches temperatures above 100° C., the NTC thermistor 170*a* must be thermally shielded from the heating unit 120 in order to ensure a certain durability while avoiding to use more expensive NTC thermistors which sustain higher temperatures. Therefore, the heating unit 120 is covered by a heat conducting plate 140 at an outer circumferential part of the carrier unit 110 covering the groove 112. The heat conducting plate 140 may comprise a projecting part 141 extending towards an inner circumferential part 113 of the carrier unit 110. This projecting part 141 is in direct contact with the dry side 102 of the carrier unit 110. Since at the opposite side of the carrier unit 110, the wet side 101, the fluid is circulated in operation, the temperature of the carrier unit 110 and thus the temperature of the projecting part 141 of the heat conducting plate 140 approximately reflects the temperature of the fluid. In order to measure the fluid temperature, the NTC thermistors 170*a* is thus mounted at the projecting part 141 of the heat conducting plate 140. In order to control the heat transfer from the heating unit 120 to the projecting part 141 on which the NTC is mounted, the heat conducting plate 140 may provide a detached portion 142 at an outer circumferential part above the heating unit 120 under the same angle as the projecting part 141 extends towards the centre. FIG. 2*b* shows a cross sectional view along the line B-B in FIG. 1. FIG. 2*b* shows that there is a space between detached portion 142 of the heat conducting plate 140 and the heating unit 120. The projecting part 141 is in contact with the detached portion 142, but is declined towards the upper surface of the carrier unit 110. Preferably, the angular expansion of the detached portion 142 is slightly broader than the angular expansion projection part 141. The heat conducting plate 140 may additionally be provided with trenches 143 at the detached portion 142 provided towards both sides of the angular expansion of the detached portion 142 wherein the length of the trenches 143 influences the amount of heat conducted from the non-detached portion 144 of the heat conducting plate 140 to the projecting portion 141.

Optionally, a second NCT thermistors may be provided, either at a further detached portion 142 in order to determine the fluid temperature, such that the first and second NTC thermistor measurements can be averaged in order to increase the liability. Alternatively, the second NTC thermistor 170*b* may be mounted at the non-detached portion 144 of the heat conducting plate 140 in order to determine the temperature of the heating unit 120 itself for preventing for instance that the pump is running dry. In the latter case, an NTC thermistor sustaining the resulting temperatures reachable by the heating unit must be chosen.

Figure 3A:
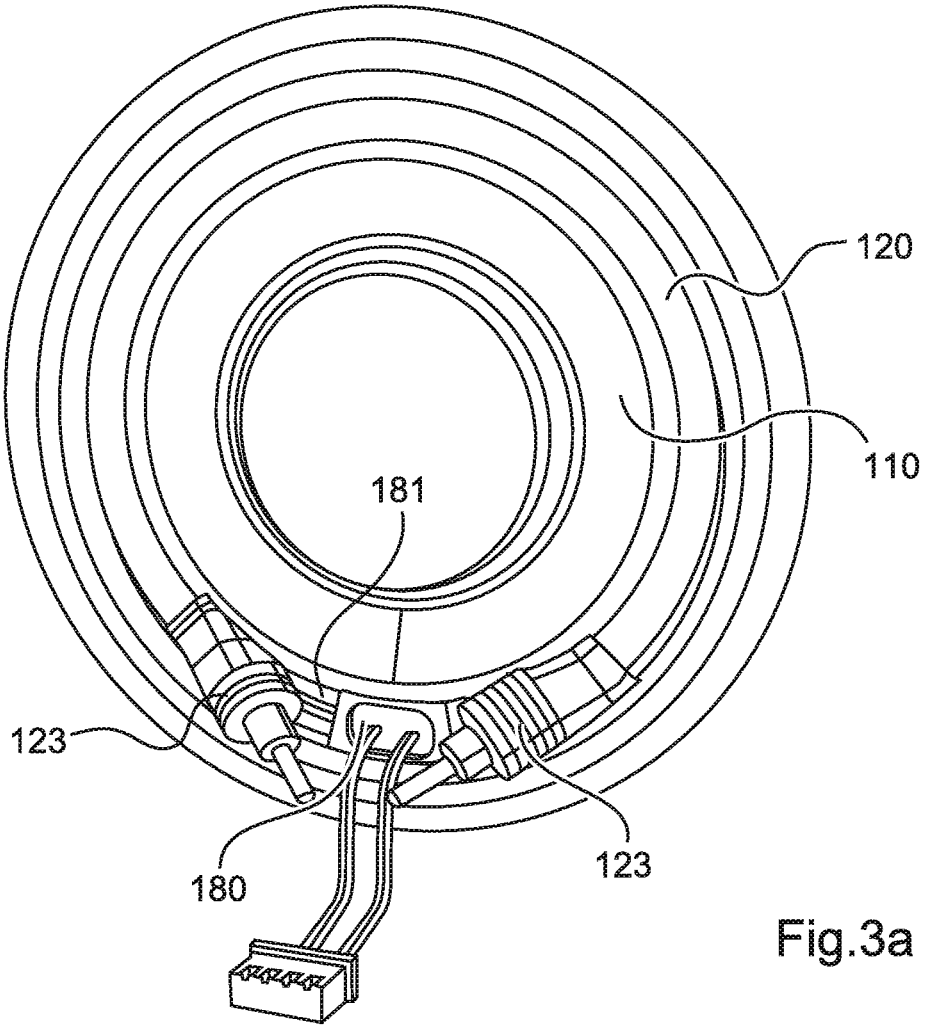
FIGS. 3*a* and 3*b* show schematically and exemplarily a further embodiment of a heating system component.
Figure 3B:
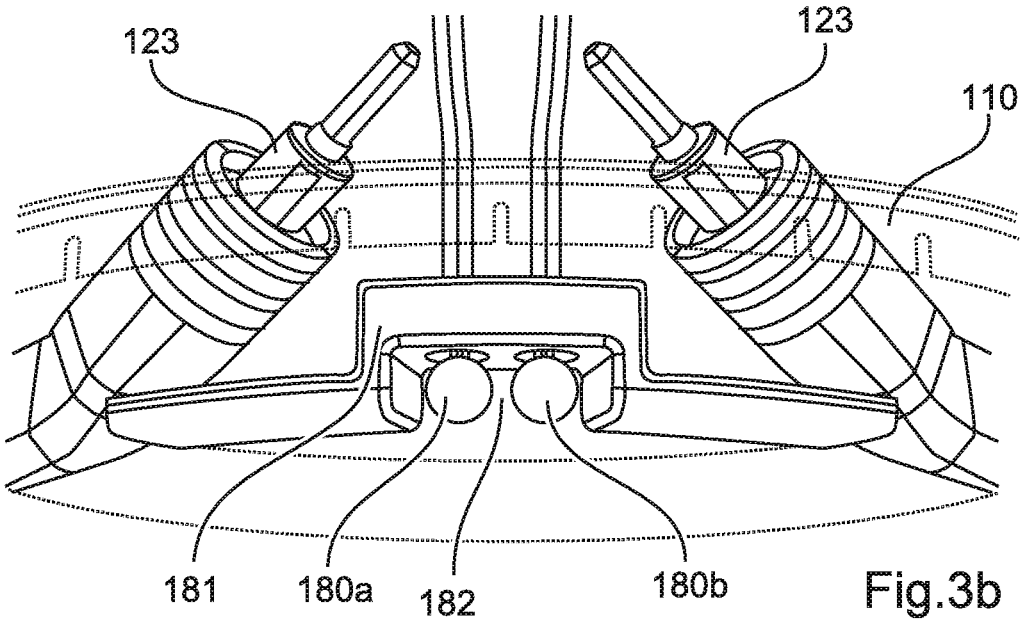

In the embodiment schematically illustrated in FIG. 3*a*, a heating system component 100 is shown which provides one or more temperature sensors, preferably NTC thermistors 180, inside the groove 112. The heating unit 120 inserted in the groove 112 of the carrier unit 110 provides connecting pins 123 at both ends of the heating unit 120. These connecting pins 123 are not located inside the groove 112, but project towards an axial direction to be connected to a power source. The temperature sensor 180 is therefore preferably provided in the portion of the groove 112 which is not covered by the heating unit 120 and is located below the connection pins 123. In order to shield the temperature sensor 180 from the heating unit 120, a shielding unit 181 is provided inside and preferably form-fit to the walls of the groove 112. The shielding unit 181 is made of a heat insulating material such as—but not limited to—stainless steel. As shown in cross-sectional view of FIG. 3*b*, the shielding unit 181 provides a hollow chamber 182 into which the temperature sensor 180*a*, preferably in form of an NTC pill, is inserted. In order to fix the NTC thermistors inside the hollow chamber 182, an epoxy resin is injected into the chamber 182, preferably a temperature resistant two-component resin. Again, optionally a second NTC thermistor 180*b* may be provided inside the hollow chamber 182 in order to determine an average temperature of the fluid circulating at the wet side 101 of the carrier unit 110. The compact, yet cost-efficient design provided by this embodiment allows a reliably measurement of the fluid temperature on the wet side 101 of the carrier unit 120 providing an easy assemble of the heating system component 100 within a respective household appliance. Since there are no components protruding from the dry side of the carrier unit, the risk of damages during assembly is significantly reduced.

Figure 4:
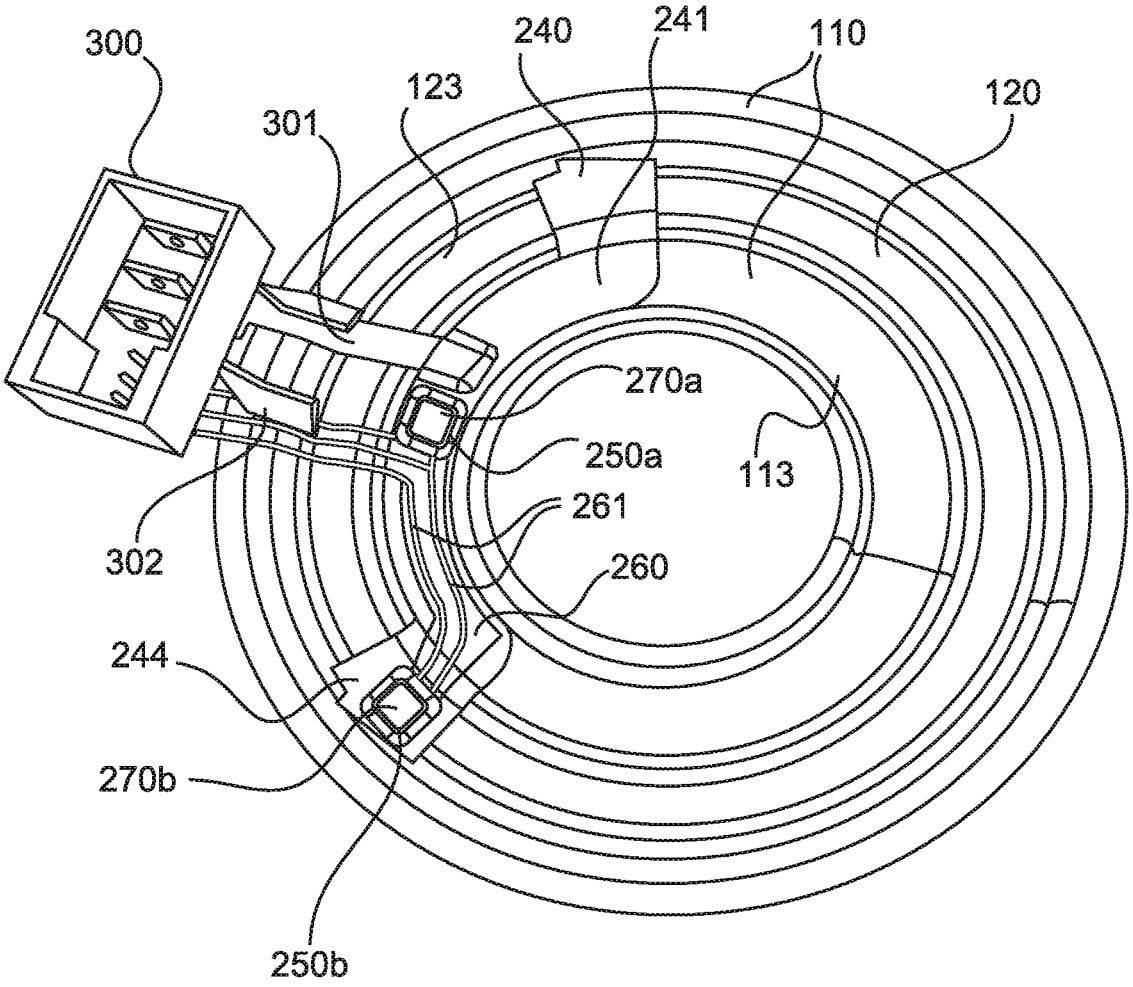
FIG. 4 shows schematically and exemplarily a further embodiment of a heating system component.

FIG. 4 schematically shows a further embodiment, in which one or more NTC thermistors 270*a*, 270*b* are provided at respective pads 250*a*, 250*b* made of a ceramic material. Each pad 250*a*, 250*b* is fixed at the heat conducting plate 240 via a form fit connection. The heat conducting plate 240 covers at least parts of an inner circumferential portion 113 of the carrier unit 110, such that an NTC thermistor 270*a* mounted at the projecting part 241 of the heat conducting plate 240 may measure the temperature of the water circulating at the wet side 101 of the carrier unit 110. Again, in case a second NTC thermistor 270*b* shall be provided, the second NTC thermistor 270*b* may either be positioned at another portion of the inner circumferential portion 113 of the carrier unit 110 or the heat conducting plate 240 may also cover at least portions 244 of the groove 112 in which the heating unit 120 is embedded such that the second NTC thermistor 270*b* may measure the temperature of the heating unit 120 itself in addition to the water temperature. The conducting paths 261 which connect the NTC thermistors 270*a*, 270*b* with an external processing unit (not shown) are electrically connected with the NTC thermistors 270*a*, 270*b*, wherein the NTC thermistor 270*a*, 270*b* and the conducting paths 261 are covered with a resin. The conducting paths 261 are preferably guided along the heat conducting plate 240 wherein a thin heat insulating layer 260, preferably a thin foil, is provided between the conducting paths 261 and the heat conducting plate 240. The thin heat insulating layer 260 is preferably made of the polyimide Kapton. However, any other suitable polyimide, polyamide or polyester may be used instead. In a preferred embodiment, a single plug 300 can be used to provide electric power to the connecting pins 123 of the heating unit 120 via respective pins 302 and to provide a connection between the conducting paths 261 from the one or more NTC thermistors 270*a*, 270*b* and an external processing unit. Preferably, the heat conducting plate 240 is grounded by the plug assembly 300 via a corresponding connection 301. Again, the compact design provides advantages during assembly of the heating system component 100 within a superordinate component into which the heating system component 100 is integrated. Having a single plug 300 to connect the heating unit 120 as well as the one or more temperature sensors 270*a*, 270*b* further decreases the complexity during assembly as well as the required material budget.

Figure 5A:
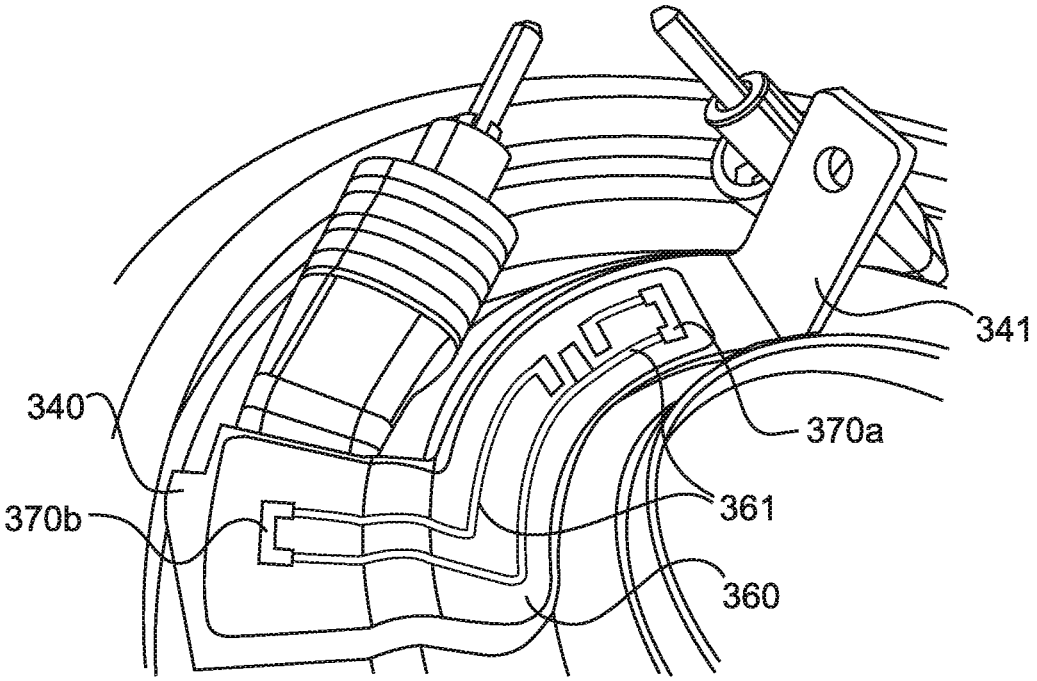
FIGS. 5*a* and 5*b* show schematically and exemplarily a further embodiment of a heating system component.
Figure 5B:
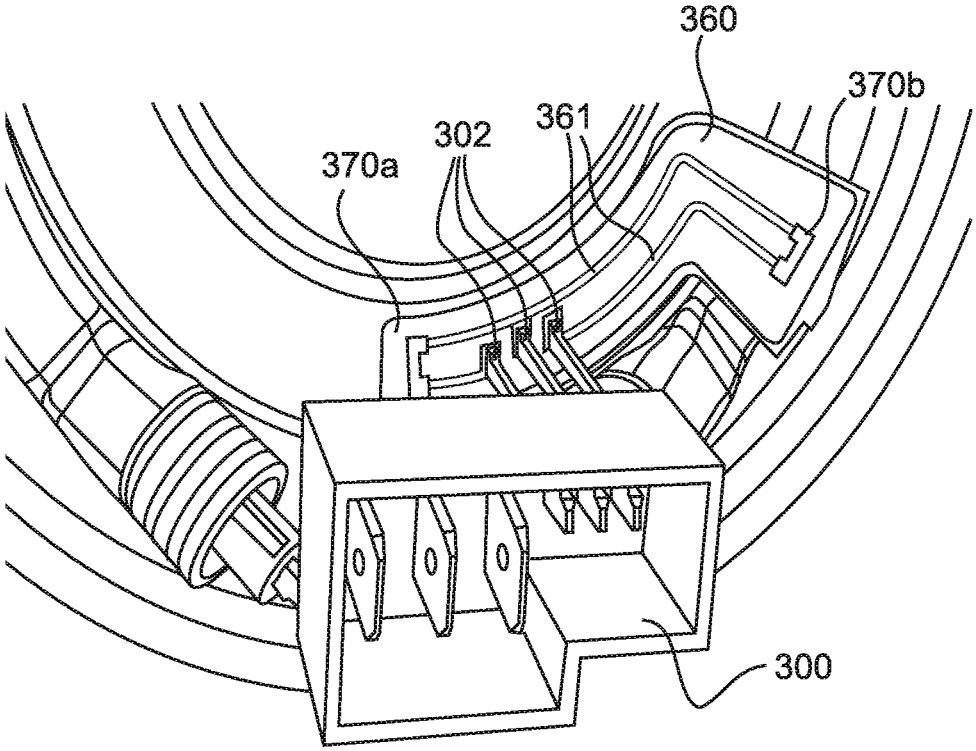

The embodiment schematically illustrated in FIG. 5*a*, also shows a heating system component 100 with a heat conducting plate 340 wherein at least a part 341 of the heat conducting plate 340 is in direct contact with the dry side 102 of the carrier unit 110 and wherein one or more NTC thermistors 370*a*, 370*b* as well as conducting paths 361 are provided thereon having an insulating layer 360, preferably in form of a thin foil, between the heat conducting plate 340 and the NTC thermistors 370*a*, 370*b* conducting paths 361. The insulating layer 360, the one or more NTC thermistors 370, and the respective conducting paths 361 are printed or sprayed onto the heat conducting plate 340 as thin layers, Wherein the insulating layer 360, preferably made of a ceramic material is provided as a first layer, the NTC thermistors 370 and the respective conducting paths 361 are provided on top of that first layer. Again, the heating system component 100 may preferably be provided with a single plug 300 as shown in FIG. 5*b* which is adapted to provide electric power to connecting pins 123 of the heating unit 120 as in the embodiment depicted in FIG. 4. Additionally, the plug 300 provides one or more connection pins 302 to be coupled to the conducting paths 361, e.g. by soldering. Preferably, the heat conducting plate 340 is grounded by the plug 300 via a corresponding connection 301 as shown in the embodiment depicted in FIG. 4. Alternatively, the grounding may be achieved by connecting an upper extension 345 of the conducting plate with ground providing a plug 300 with connection pins 302 at the bottom to be connected with the conducting paths 361 and a ground connection to the side of the plug 300. Again, the compact design provides advantages during assembly of the heating system component 100 within a superordinate component into which the heating system component 100 is integrated. Having a single plug 301 to connect the heating unit 120 as well as the one or more temperature sensors 370 further decreases the complexity during assembly as well as the required material budget.

Figure 6A:
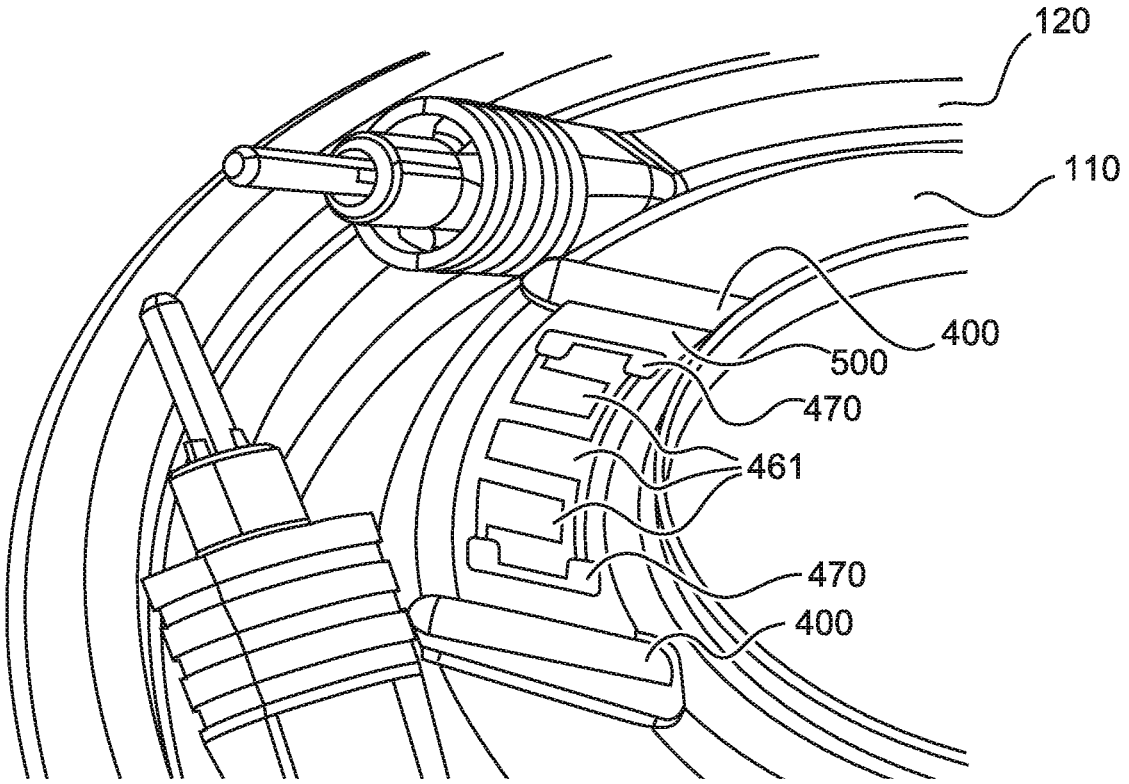
FIGS. 6*a* and 6*b* show schematically and exemplarily a further embodiment of a heating system component.
Figure 6B:
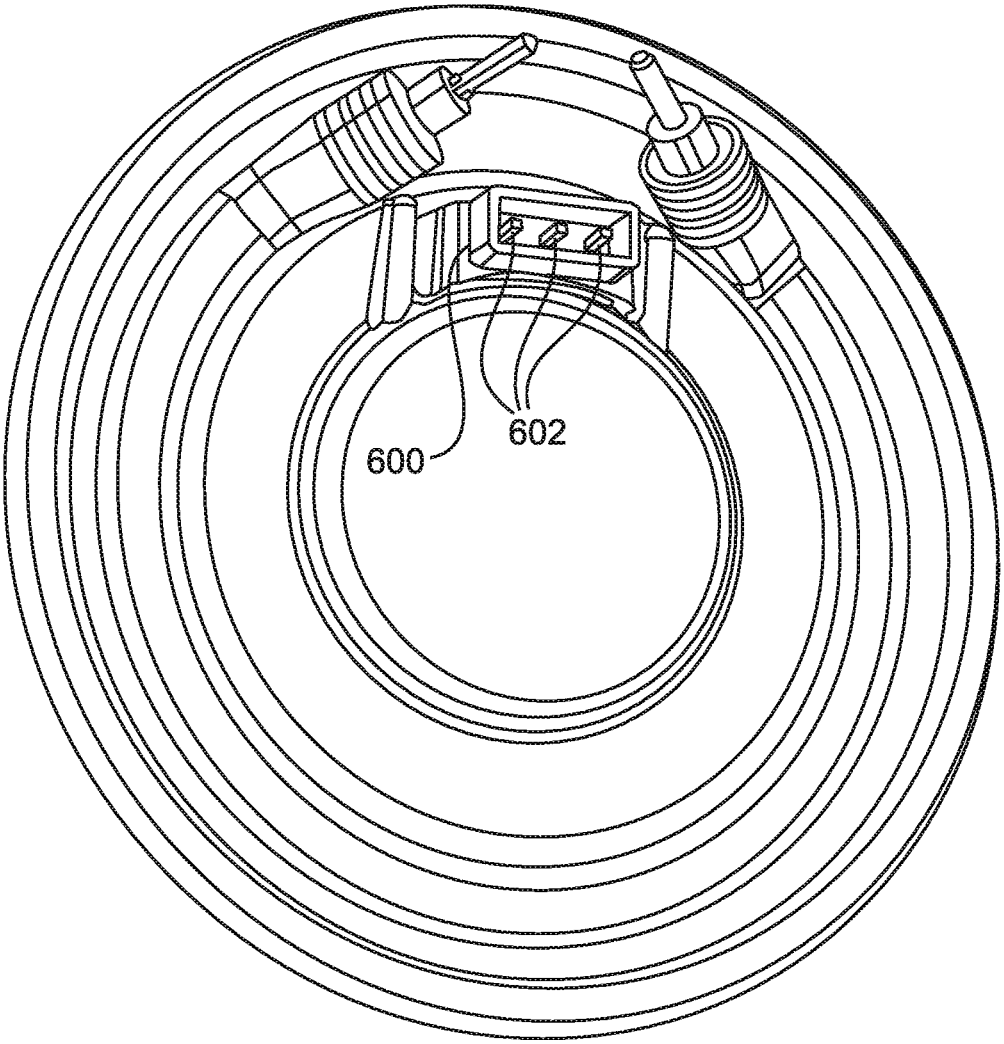

FIG. 6*a* schematically shows a further embodiment, in which one or more temperature sensors 470 are provided at an inner circumferential portion of the carrier unit 110, wherein the carrier unit 110 comprises an undercut portion 400 which is filled with a thermoplastic layer 500 by injection-molding to form the bases of a so-called molded interconnect device (MID). In a first step, the undercut portion 400 is provided with a microstructure by a thin laser beam. The thermoplastic is provided on top of the microstructured surface of the metal layer. The metal layer is heated up by a further laser beam while the thermoplastic is pressed onto the microstructure at surface in order to provide a hybrid metal-plastic connection. The thermoplastic layer 500 is doped with a metal-plastic additive that can be activated by exposure to a laser beam. This process is commonly referred to as metallization, wherein two different sections are metalized, one for the temperature sensors 470, e.g. NTC thermistors, and the other for the conducting paths 461. The NTC thermistors 460 and respective conducting paths 461 are cut free with a laser. Also in this embodiment, a form fit plug 600 is provided having connection pins 602 to connect to the respective conducting paths 461. The housing of the plug 600 is preferably made of a transparent plastic material which can be laser-welded to the thermoplastic layer 500 which should therefore preferably be made of thermoplastic material absorbing the energy of a laser beam which previously passes the transparent plug 600 housing without depositing significant amounts of energy in the plastic material and thus deforming it. The form fit design provided by this embodiment eases the assembly of the heating system component 100 into a super ordinate system as well as reduces the size and material budget required to implement a temperature sensor 460 for the heating system component 100.

Figure 7:
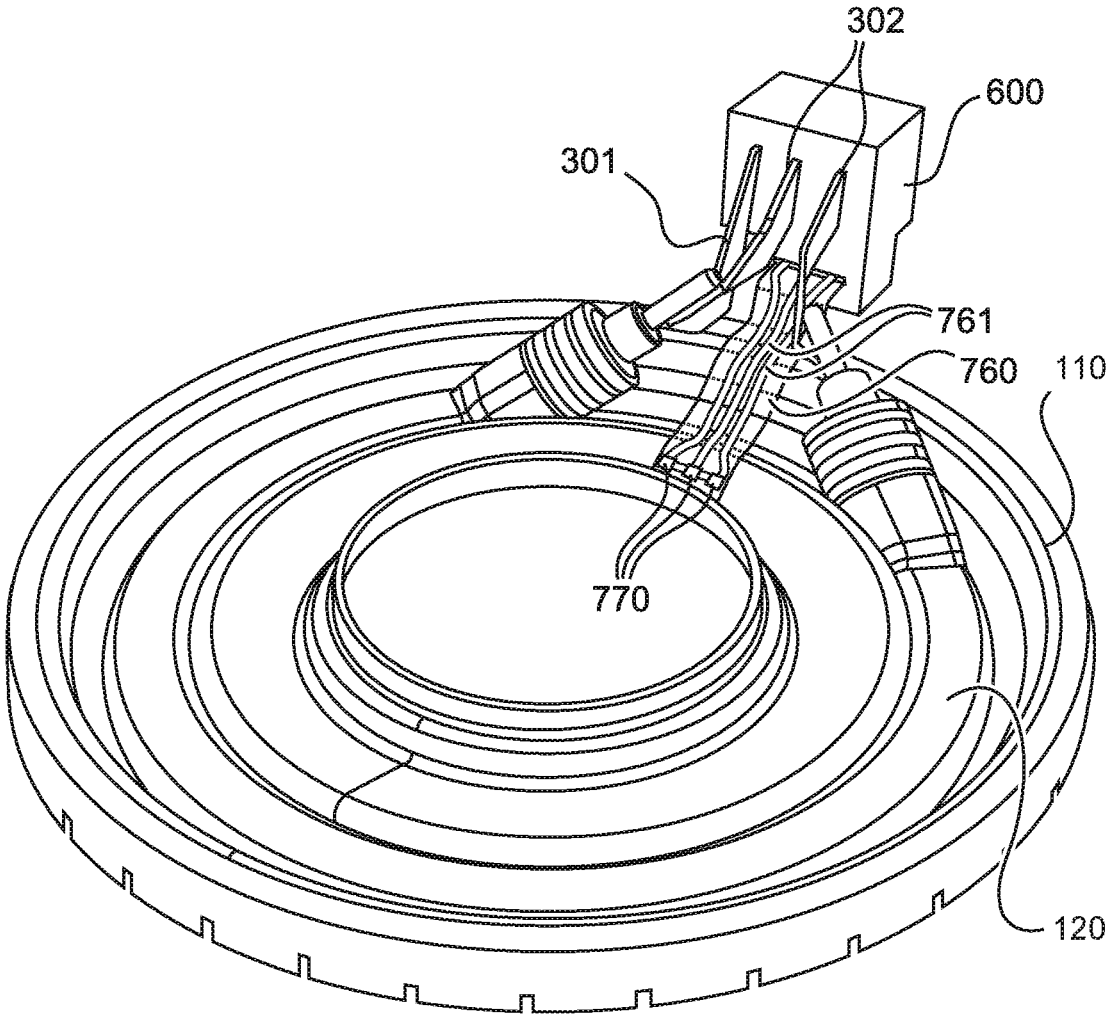
FIG. 7 shows schematically and exemplarily a further embodiment of a heating system component.

FIG. 7 schematically shows a further embodiment, in which one or more temperature sensors, in particular NTC thermistors 770 as well as the conductor paths 761 between the one or more NTC thermistors 770 and an external plug are formed at a thin layer 760, preferably a thin polymer foil, before the foil is attached to the carrier unit 110. NTC thermistors 770 as well as the conductor paths 761 may either be formed by printing, vapor deposition or metallization. Preferably, the sensor foil is pre-assembled with a suitable plug 600 providing conductor pins to the conductor paths as well as preferably also power connections for the heating unit and as well as a pin to ground the carrier unit. The plug 600 may then be mounted at the carrier unit 710 by welding, in particular spot welding the power connections 302 and a ground connection 301 to the heating unit 120 and carrier unit 710, respectively. The thin foil 760 is then attached to the carrier unit 710 by gluing at least a portion of the lower side of the foil 760 to the dry side of the carrier unit 110 using a heat resistant gluing material. The NTC thermistors are preferably positioned at a portion of the dry side of the carrier unit 110 whose wet side is in contact with the fluid circulating at the wet side. The embodiment allows a particular flexible way of arranging the temperature sensors at a desired position of the carrier unit. Furthermore, the embodiment provides a very compact design without any protrusions or cables which require space and caution during assembly.

An example application of the invention generally relates to situations where a fluid medium needs to be heated in an efficient manner, for example in household appliances such as dishwashers, dryers, and washing machines, small electrical appliances such as coffeemakers, irons, steam generators etc. or in water heaters. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Determinations like measuring a temperature performed by one or several units or devices can be performed by any other number of units or devices. For example, measuring a temperature can be performed by a single temperature sensor or by any other number of different units. The determinations and/or the control of the heating system for heating fluid media can be implemented as program code means of a computer program and/or as dedicated hardware.

A computer program may be stored/distributed on a suitable medium, such as an optical storage medium or a solid-state medium, supplied together with or as part of other hardware, but may also be distributed in other forms, such as via the Internet or other wired or wireless telecommunication systems. The term "computer program" may also refer to embedded software.

Any reference signs in the claims should not be construed as limiting the scope.

The invention claimed is:

1. A heating system component for a heating system for heating a fluid medium, said heating system component comprising:

a carrier unit;

a heating unit coupled to said carrier unit;

wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit;

wherein the heating system component further comprises at least one temperature sensor, in particular an NTC thermistor, wherein said temperature sensor is effectively in thermal contact with at least a part of an upper surface of said dry side of the carrier unit, wherein the part of the upper surface of the carrier unit is in contact with said fluid medium at the opposing wet side, and wherein the part of the upper surface of the carrier unit being in thermal contact with the temperature sensor is effectively thermally insulated from the heating unit; and wherein the heating system component further comprises a heat conducting plate covering at least a part of the groove, wherein the heat conducting plate comprises a projecting part extending beyond the groove of the carrier unit, the projecting part being in direct contact with the dry side of the carrier unit; wherein at least a part of the heat conducting plate is covered with a thermoplastic layer doped with a metal-plastic additive directly sprayed at least at a part of the projecting part and subsequently metalized at respective portions of an upper surface of the thermoplastic layer; wherein the temperature sensor and conductor paths connected to the temperature sensor are formed at the metalized thermoplastic layer by laser cutting.

2. A heating system component for a heating system for heating a fluid medium, said heating system component comprising:

a carrier unit;

a heating unit coupled to said carrier unit;

wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit;

wherein the heating system component further comprises at least one temperature sensor, in particular an NTC thermistor, wherein said temperature sensor is effectively in thermal contact with at least a part of an upper surface of said dry side of the carrier unit, wherein the part of the upper surface of the carrier unit is in contact with said fluid medium at the opposing wet side, and wherein the part of the upper surface of the carrier unit being in thermal contact with the temperature sensor is effectively thermally insulated from the heating unit;

wherein said temperature sensor is provided inside the groove of the carrier unit shielded from the heating unit by a shielding unit; and wherein the heating system component further comprises a second temperature sensor provided inside the groove shielded from the heating unit by the shielding unit, wherein the resulting temperature is derived from an average temperature measured by the first and second temperature sensors.

3. The heating system component according to claim 2, wherein the first and second temperature sensors are NTC thermistor pills cast in epoxy resin between the dry side of the carrier unit and the shielding unit.

4. A heating system component for a heating system for heating a fluid medium, said heating system component comprising:

a carrier unit;

a heating unit coupled to said carrier unit;

wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit;

wherein the heating system component further comprises at least one temperature sensor, in particular an NTC thermistor, wherein said temperature sensor is effectively in thermal contact with at least a part of an upper surface of said dry side of the carrier unit, wherein the part of the upper surface of the carrier unit is in contact with said fluid medium at the opposing wet side, and wherein the part of the upper surface of the carrier unit being in thermal contact with the temperature sensor is effectively thermally insulated from the heating unit; and wherein the carrier unit comprises an undercut portion which is covered with a thermoplastic layer doped with a metal-plastic additive directly sprayed at the undercut portion and subsequently metalized at respective portions of an upper surface of the thermoplastic layer; wherein the temperature sensor and conductor paths connected to the temperature sensor are formed at the metalized thermoplastic layer by laser cutting.

5. The heating system component according to claim 4, comprising a transparent plug comprising the electrical contacts to be connected with the conductor paths leading to the temperature sensor wherein the transparent plug is coupled with the thermoplastic layer via laser welding.

6. A heating system component for a heating system for heating a fluid medium, said heating system component comprising:

a carrier unit;

a heating unit coupled to said carrier unit;

wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit;

wherein the heating system component further comprises at least one temperature sensor, in particular an NTC thermistor, wherein said temperature sensor is effectively in thermal contact with at least a part of an upper surface of said dry side of the carrier unit, wherein the part of the upper surface of the carrier unit is in contact with said fluid medium at the opposing wet side, and wherein the part of the upper surface of the carrier unit being in thermal contact with the temperature sensor is effectively thermally insulated from the heating unit;

wherein the heating system component further comprises a heat conducting plate covering at least a part of the groove, wherein the heat conducting plate comprises a projecting part extending beyond the groove of the carrier unit, the projecting part being in direct contact with the dry side of the carrier unit; and wherein the temperature sensor is provided at a ceramic pad fixed at a projection part of the carrier unit; and wherein one or more conductor paths are provided along the heat conduction plate to connect the one or more temperature sensors, wherein the conductor paths are insulated from the heat conduction plate by an insulating layer, preferably comprising Kapton.

7. A heating system component for a heating system for heating a fluid medium, said heating system component comprising:

a carrier unit;

a heating unit coupled to said carrier unit;

wherein said carrier unit comprises a wet side and a dry side, wherein said wet side corresponds to a surface of said carrier unit configured to be in contact with said fluid medium, wherein said dry side is located on a surface opposite to said wet side; and wherein said heating unit is recessed in a groove provided on said dry side of the carrier unit;

wherein the heating system component further comprises at least one temperature sensor, in particular an NTC thermistor, wherein said temperature sensor is effectively in thermal contact with at least a part of an upper surface of said dry side of the carrier unit, wherein the part of the upper surface of the carrier unit is in contact with said fluid medium at the opposing wet side, and wherein the part of the upper surface of the carrier unit being in thermal contact with the temperature sensor is effectively thermally insulated from the heating unit; and wherein the heating system component further comprises a heat conducting plate covering at least a part of the groove, wherein the heat conducting plate comprises a projecting part extending beyond the groove of the carrier unit, the projecting part being in direct contact with the dry side of the carrier unit; wherein at least a part of the heat conducting plate is covered with an insulating layer on top of which the temperature sensor and conductor paths connected to the temperature sensor are formed.

8. The heating system component according to claim 6, further comprising a plug with pins to be connected to the conductor paths wherein the plug also provides electric connections for the heating unit.

9. The heating system component according to claim 6, wherein the temperature sensor and the insulating layer are formed at the heat conducting plate by printing or thermal spraying.

* * * * *